United States Patent [19]

Aron

[11] 3,953,894

[45] May 4, 1976

[54] REVERSIBLE NECKTIE AND METHOD OF PRODUCTION

[76] Inventor: Richard M. Aron, 31 Caprice Drive, Stamford, Conn. 06902

[22] Filed: June 25, 1975

[21] Appl. No.: 590,262

[52] U.S. Cl. ..... 2/146
[51] Int. Cl.[2] ..... A43D 25/06
[58] Field of Search ..... 2/146, 155, 144, 157

[56] References Cited

UNITED STATES PATENTS

| | | | |
|---|---|---|---|
| 2,016,126 | 10/1935 | Starkey | 2/146 |
| 2,126,835 | 8/1938 | Steinberger | 2/146 |
| 2,263,258 | 11/1941 | Boland | 2/146 |
| 3,744,057 | 7/1973 | Luceri | 2/146 |

*Primary Examiner*—G. V. Larkin
*Attorney, Agent, or Firm*—William R. Liberman

[57] ABSTRACT

A two-faced necktie is provided having an interior lining comented throughout its breadth to the underside of one of the face layers, the two face layers being stitched together along a line determined by the length and width of the liner, the longitudinal edges of the two face layers beyond the stitch lines being turned in under the liner.

4 Claims, 7 Drawing Figures

REVERSIBLE NECKTIE AND METHOD OF PRODUCTION

BACKGROUND OF THE INVENTION

Neckties, having faces of different fabrics and/or patterns, are well known in the industry. U.S. Pat. No. 3,744,057 to Luceri discloses one possible method of forming a necktie, having faces of different fabrics. However, in this method the lining is inserted after the necktie has been reversed, which requires a special tool and adds considerably to the cost of manufacture. Another difficulty is in properly fitting the lining inside the necktie so that it presents a smooth appearance and permits ready knotting.

SUMMARY OF THE INVENTION

An object of the present invention is to provide a two-faced necktie; i.e., a necktie which can be worn selectively to display the fabric on one side or on the other.

Another object of the present invention is to provide a method of uniting the elements of a two-faced lined necktie whereby the marginal edges of the facing panels are easily secured together so as to provide smooth lateral margins when the necktie is reversed for wear.

Still another object of the present invention is to provide a two-faced lined necktie wherein the lining layer is permanently affixed to one of the face panels, and the face panels are permanently secured to each other by a line of stitching which closely follows the peripheral margins of the lining layer.

The invention consists of two necktie face layers or portions of substantially but not necessarily identical outline. On the back surface of one face portion, an accurately formed liner of the same or similar overall outline, but of smaller dimension, is permanently attached throughout its length. The attachment may be by mechanical or chemical adhesion. The two face layers are arranged in face-to-face relationship with the liner on the then upper aspect of one of the face layers. The face layers are then stitched together by means of a line of stitching which closely and precisely follows the periphery of the lining and close thereto, except at the neckband portion where one side is left unstitched so as to provide an opening to facilitate reversal of the secured-together layers, after which the open portion of the neckband is suitably closed.

EMBODIMENT OF THE INVENTION

Figure 1:
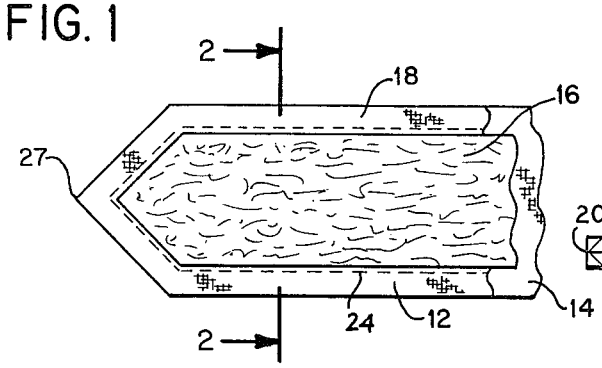
FIG. 1 is a top view of the body portions of two face layers in superposed relationship with the lining on the back of one of the layers.

The two-faced necktie of the present invention is indicated by reference numeral 10, and comprises face portions or layers 12, 14 of generally, but not necessarily, the same shape, length, and width, and of the same or different fabric patterns. A suitable lining 16 is provided and cut to the shape (length and width) of the desired end product but of slightly narrower and shorter size. Lining 16 is bonded to the back surface 18 of one of the face layers, in this case layer 12. This bonding can be achieved by any suitable means, as by heat sealing or adhesives.

Figure 2:
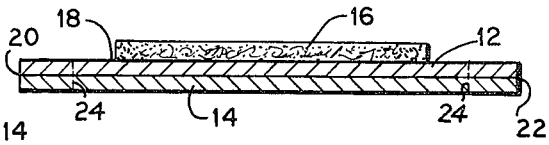
FIG. 2 is a cross-sectional view on the line 2—2 of FIG. 1.

As best shown in FIG. 2, in forming the neckties of the present invention, the face layers 12, 14 are superposed with their ultimately outer faces 20, 22 disposed one against the other. They are then sewn together by a line of stitching 24 extending around but slightly and uniformly spaced from the periphery of the lining 16, since the lining constitutes the guide for the stitching except along one side of the neckband portion 26, to leave an opening between layers 12, 14 whereby the original arrangement of the necktie layers can be reversed in conventional manner. The front and rear ends 28 of the necktie are then pulled through the opening, reversing the necktie layers, so that the front faces 20, 22 are now exposed on opposite sides of the necktie, and lining 16 is inside the necktie between layers 12, 14. The precision stitching of the face layers, using the marginal edge of the liner as a guide, facilitates the reversal of the necktie tube, and the accurate alignment of the edges of the two face layers, the free edges of which are hidden within the tube extending between the lining and the other of the face layers. This method of stitching the face layers also facilitates the final pressing of the necktie since there is no need for aligning the side edges of the face layers.

Figure 3:
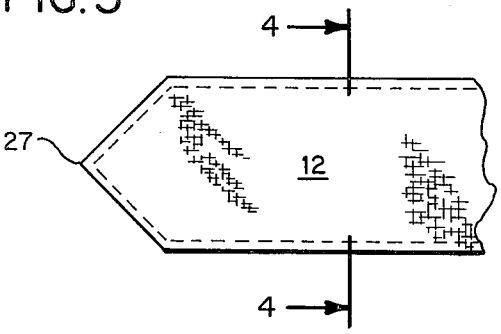
FIG. 3 is a view similar to FIG. 1 but after the reversal step.
Figure 4:
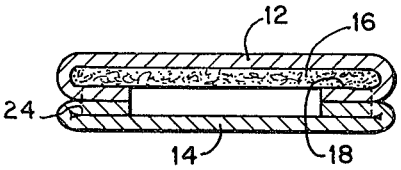
FIG. 4 is a cross-section view on the line 4—4 of FIG. 3.
Figure 5:
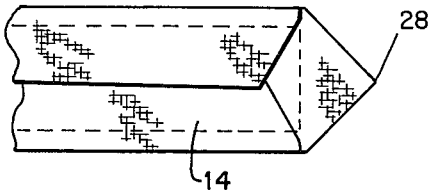
FIG. 5 is a top view of the tail end of a conventionally made one-sided necktie.
Figure 6:
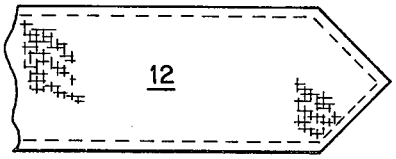
FIG. 6 is a top view of the tail end of a necktie made in accordance with this invention.
Figure 7:
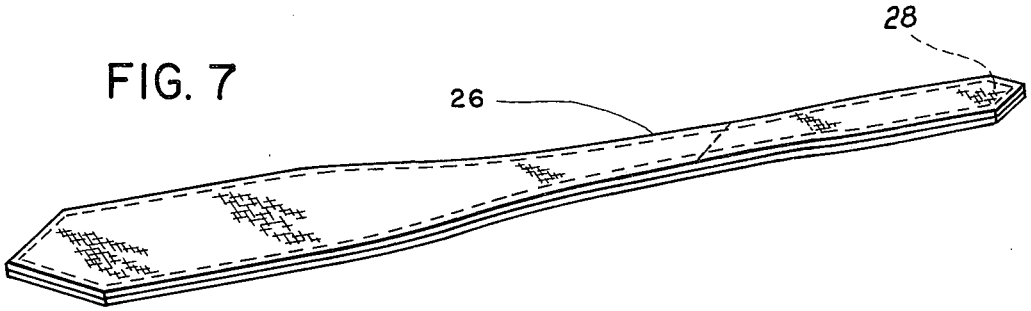
FIG. 7 is a top view of the entire necktie produced in accordance with this invention.

FIGS. 3 and 4 show the main body of the necktie 10 after it has been reversed. The free, lateral, marginal edges of the face layers 12, 14 beyond the line of stitching 24 are positioned and out of sight inside the necktie 10, providing smooth, clean marginal edges of the necktie. This method of securement and reversal renders it unnecessary to cut the face layers to precise width.

The face panels may be formed of a single length of the desired material or may be made up of two pieces; one for the main body portion of the necktie, and another, less expensive piece for the tail end 28 of the necktie, since the tail end is not ordinarily seen when the necktie is being worn. Optionally, tail end 28 of the necktie may be formed by any suitable means for forming conventional one-sided ties, or it may be formed in accordance with the present invention. As will be readily understood, the opening in the neckband portion of the necktie, after reversal, is closed by additional stitch lines.

I claim:

1. A two-faced necktie comprising two coincident face layers; a liner secured throughout its length and width to the back of one of the face layers inwardly of the marginal edges thereof, said liner being substantially coextensive in length with the major portion of the necktie and a line of stitching securing the two face layers together along the lateral edges thereof, the line of stitching closely following the periphery of the liner and uniformly spaced therefrom, except at one side of the neckband portion of the necktie, the liner being coextensive in width with said one face layer only between the lateral stitch lines and slightly inwardly thereof.

2. The necktie of claim 1, wherein the liner is bonded throughout its area to the rear aspect of one of the face layers.

3. The necktie of claim 1, wherein, throughout the length of the necktie, the free, marginal edges of the two face layers beyond the line of stitching extend between the liner and the other of the face layers inside the necktie.

4. The method of making a lined two-faced necktie comprising the steps of bonding a liner to the back surface of one of the necktie face layers; stitching the face necktie layers together in face-to-face relationship about and closely and uniformly following the periphery of the liner except at the neckband portion and along one side thereof only, using the lateral marginal edges of the liner as the stitch guide; and thereafter reversing the necktie so that the faces are now on the outer aspects of the necktie and the free marginal edges of the face layers are disposed between the liner and the other of the face necktie layers, and closing the said one side of the neckband portion.

* * * * *